United States Patent [19]

Riedel

[11] 4,182,523

[45] * Jan. 8, 1980

[54] SKI BRAKE

[75] Inventor: Tilo Riedel, Eching, Fed. Rep. of Germany

[73] Assignee: S.A. Etablissements Francois Salomon & Fils, Annecy, France

[ * ] Notice: The portion of the term of this patent subsequent to Oct. 31, 1995, has been disclaimed.

[21] Appl. No.: 911,327

[22] Filed: Jun. 1, 1978

Related U.S. Application Data

[60] Division of Ser. No. 678,706, Apr. 20, 1976, Pat. No. 4,123,083, which is a continuation-in-part of Ser. No. 666,232, Mar. 12, 1976, abandoned.

[30] Foreign Application Priority Data

| | | | |
|---|---|---|---|
| Mar. 19, 1975 | [DE] | Fed. Rep. of Germany | 2512052 |
| Apr. 22, 1975 | [DE] | Fed. Rep. of Germany | 2517794 |
| Apr. 22, 1975 | [DE] | Fed. Rep. of Germany | 2517820 |
| Apr. 22, 1975 | [DE] | Fed. Rep. of Germany | 2517829 |
| Apr. 22, 1975 | [DE] | Fed. Rep. of Germany | 2517838 |
| Apr. 22, 1975 | [DE] | Fed. Rep. of Germany | 2517861 |
| Apr. 22, 1975 | [DE] | Fed. Rep. of Germany | 2517862 |
| May 2, 1975 | [DE] | Fed. Rep. of Germany | 2519779 |

[51] Int. Cl.[2] ..... A63C 17/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,724,867 | 4/1973 | Hawthorne | 280/605 |
| 4,123,083 | 10/1978 | Riedel | 280/605 |

*Primary Examiner*—David M. Mitchell

*Attorney, Agent, or Firm*—Karl F. Ross

[57] ABSTRACT

A ski brake has a pair of elongated braking elements which extend parallel to each other and are pivoted about their middle portions about a pivot axis extending parallel to the upper surface and transverse to the longitudinal direction of a ski so that these braking elements can pivot between a rest position parallel to the ski and a braking position transverse to the ski and digging into the snow under the ski. An actuating member or plate is displaceable toward and away from the upper surface of the ski and is linked to the upper ends of the braking elements so that its displacement toward the surface of the ski will swing the elements into the rest position. In addition this actuating member is provided with links or similar means which tend to swing the lower ends of the braking elements inwardly above the surface of the ski so that they do not project laterally from the ski during use thereof. A pivot spring normally urges the elements into the braking position and another spring urges them into the retracted position above the upper ski surface.

6 Claims, 20 Drawing Figures

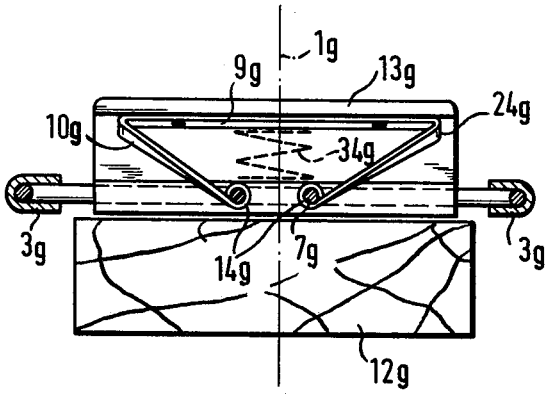
Fig. 16
Fig. 15
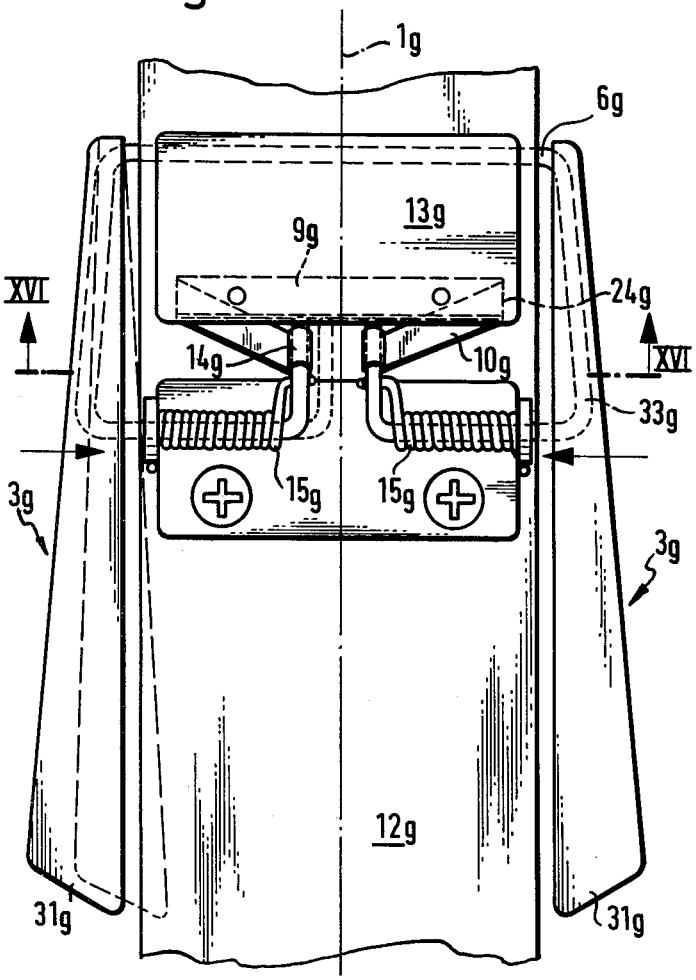
Fig.17
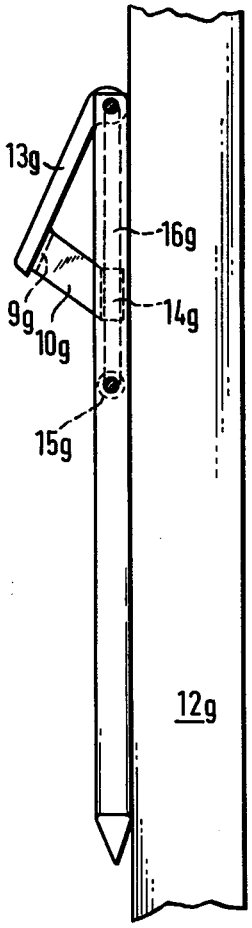

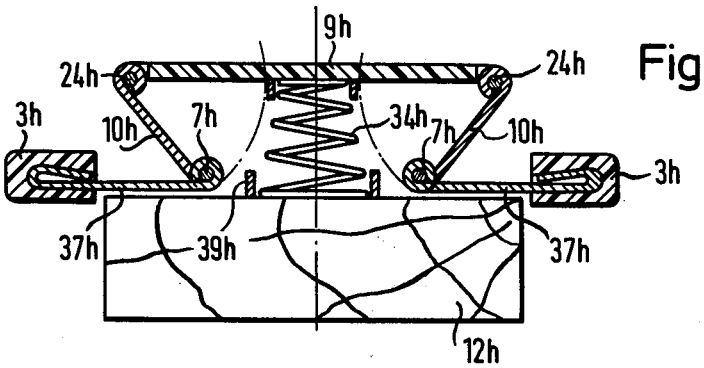
Fig. 19
Fig. 18
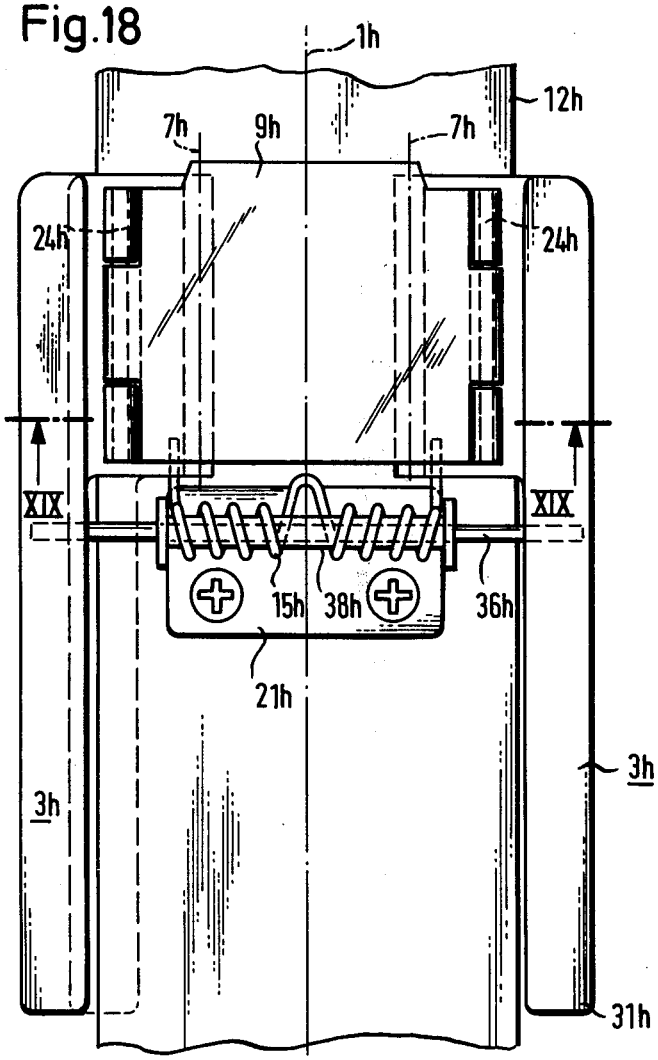
Fig. 20
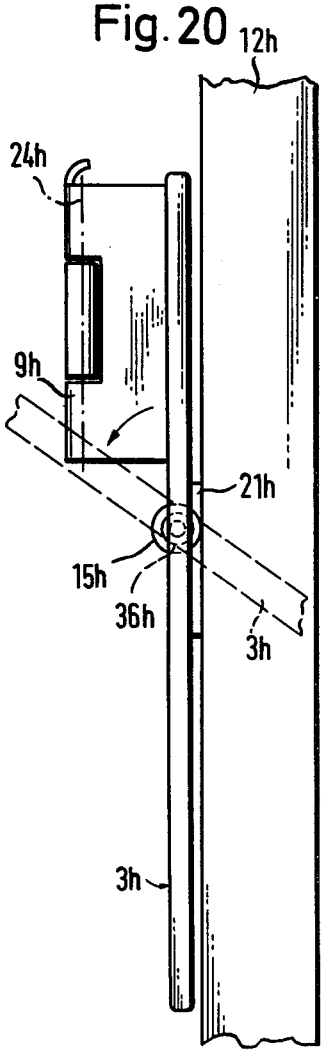

SKI BRAKE

CROSS-REFERENCE TO RELATED APPLICATIONS

This is a division of my copending and commonly assigned application Ser. No. 678,706, now U.S. Pat. No. 4,123,083, filed Apr. 20, 1976 as a continuation-in-part of my copending and commonly assigned application Ser. No. 666,232 filed Mar. 12, 1976, and now abandoned, which in turn refers to my then pending earlier applications which issued as U.S. Pat. Nos. 3,989,271 and 3,964,760.

BACKGROUND OF THE INVENTION

The present invention relates to a ski brake. More particularly this invention concerns a device which stops a ski when it separates from its ski boot.

Even though most slopes require the skiers to secure their ski bindings to their ski boots by means of ties, it is a frequent occurrence that as a result of a violent fall a ski pulls loose from the skier and slides down the slope. Such a free-running ski can attain high speeds and therefore presents a considerable hazard to other people on the slope.

For this reason a so-called ski brake has been designed which comprises one or two braking elements which are pivoted on the ski at the level of the ski boot and can move from positions generally parallel to the upper surface of the ski to positions generally transverse to the upper surface of the ski and extending down below the lower face of the ski. An actuating member on the ski is engaged by the ski boot to move the elements into the position parallel to the ski where they do not interfere substantially with skiing, whereas a spring pivots the braking elements automatically into the braking position should the ski boot pull off the actuating member. Thus in case of a fall the braking elements automatically assume the braking position and prevent the ski from sliding, as they dig plow-fashion into the snow.

A considerable disadvantage of the known ski brakes is that the elements interfere with skiing when in the rest position parallel to the ski. These elements can fill up with snow and can even catch on objects such as brush or grass which would not otherwise interfere with skiing. Furthermore, it is a frequent occurrence that such ski brakes clog up with snow and ice and become almost completely inoperative so that when the ski boot separates from the ski the braking elements are unable to assume the braking position.

SUMMARY OF THE INVENTION

It is therefore an object of the present invention to provide an improved ski brake.

Another object is to further principles disclosed in my above-identified patent application.

Another object is to provide a ski brake wherein the ski elements are not likely to interfere with skiing or become clogged with ice or snow.

These objects are attained according to the present invention by means which convert the force acting perpendicular to the surface of the ski on the actuating member into forces acting parallel to the surface of the ski to swing the braking elements into retracted positions overlying the upper surface of the ski. Thus when the ski brake is moved from the braking to the rest position the braking elements are swung about axes perpendicular to the surface of the ski from ready positions with the lower tip of the brake elements spaced laterally from the ski into retracted positions with these lower tips or ends overlying the upper surface of the ski and completely out of the way.

Thus the ski brake according to the present invention has a support securable to an upper surface of the ski, a pivot on the support defining a pivot axis extending generally perpendicular to the longitudinal axis of the ski and generally parallel to the upper surface of the ski, at least one elongated brake element as described above with the lower end engageable in the snow and an opposite upper end, a pivot spring normally urging the element into the braking position, and means including the actuating member displaceable perpendicularly relative to the surface for moving the braking elements into the rest and retracted positions. The support may be a separate element secured to the ski, or can indeed be wholly or partially constituted by the ski itself.

According to this invention a pair of such brake elements are provided flanking the support and pivoted about intermediate portions on this support. The actuating element lies to that side of the pivot which corresponds to the upper ends of the braking elements when they are in the rest position. These braking elements are formed usually of synthetic-resin material over a wire core.

The actuating element in accordance with the present invention may comprise a synthetic-resin bar or strip which bridges and is secured to the upper ends of the brake elements and is of non-straight shape. Thus when pressed down against the flat upper surface of the ski this element, which is made of elastically resilient material, is flattened so as to press the upper ends of the brake elements apart and swing them into the retracted position.

In accordance with another feature of this invention the actuating member is rigid and is connected via links to wires imbedded in the brake elements and constituting the pivots. The upper ends of the elements in this type of arrangement are fixedly spaced and the links in the braking position lie at an angle to the upper surface of the ski. Thus when flattened out the intermediate pivoted portions of the braking elements are pulled toward one another so as to pull these braking elements into the retracted position.

According to other features of this invention the pivot spring can comprise a coil spring wound around the pivot and having one end engaging the respective brake element and another end engaging the support. Indeed such a spring can constitute the pivot, with each end imbedded in a respective one of the brake elements and a central portion formed as a loop bearing against the support. Such an arrangement readily allows for deformation of the pivot for inward swinging of the lower ends of the brake elements.

According to further features of this invention each brake element is mounted on a single wire or wire portion that is made of spring steel and shaped so as normally to urge the respective element into the braking position. Thus this wire can constitute the pivot spring and pivot for the respective braking element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 15 is a top view of the fifth embodiment of the ski brake of this invention with the brake elements in the ready position;

FIG. 16 is a section taken along line XVI—XVI of FIG. 15;

FIG. 17 is a side view of the brake of FIG. 15 in the ready position;

FIG. 18 is a top view of a modification of the arrangement of FIG. 15 with the brake elements in the ready position;

FIG. 19 is a section taken along line XIX—XIX of FIG. 18; and

FIG. 20 is a side view of the brake of FIG. 18 in the ready position.

DESCRIPTION OF THE PREFERRED EMBODIMENTS

Figure 1:
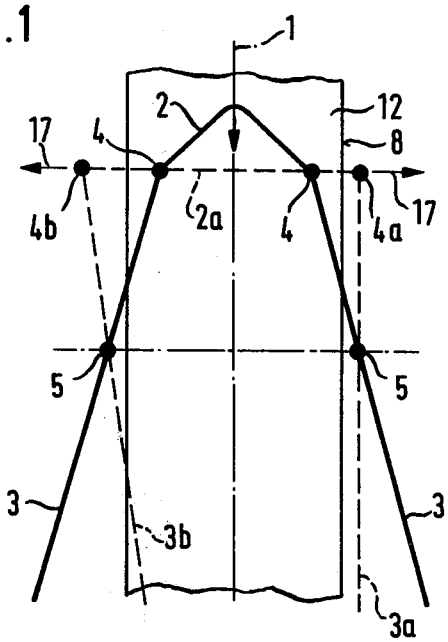
FIGS. 1 and 2 are top schematic views illustrating operation of the systems according to this invention.
Figure 2:
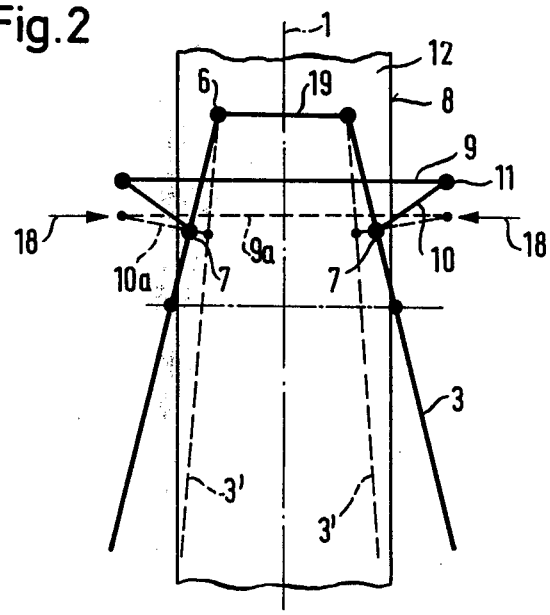

Referring now to the drawings and first to FIGS. 1 and 2 thereof, it is to be mentioned that a ski brake is to be used in connection with a ski 12. The ski is elongated and has a longitudinal axis 1, a lower surface which is in contact with the surface of a layer of snow during the operation of the ski, and an upper surface on which a non-illustrated conventional ski binding is mounted. It is to be understood that the longitudinal direction conforms with the direction of the axis 1 of the ski 12, transverse direction is across the axis 1 and located in a plane parallel to the upper surface of the ski 12 and that lateral means adjacent a side surface 8 of the ski 12. Similarly, upward and downward directions are to be understood to extend substantially normal to a plane defined by the longitudinal and the transverse directions.

Referring now particularly to the embodiment illustrated in FIG. 1, it may be seen that the reference numeral 3 indicates a braking element, such as a lever, which has a free end provided with an engaging portion. It will be more clearly explained as the discussion progresses that the respective lever 3, of which a pair is illustrated in FIG. 1, is mounted on the ski by means of a pivot 5 for displacement between an engaging or braking position in which the engaging portion of the lever engages the surface underneath the ski in a region laterally adjacent the ski 12, and an intermediate, ready, or rest position which is illustrated in full lines in FIG. 1 and in which the free end portion of the respective lever 3 is located above and laterally of the upper surface of the ski. The respective pivot 5 also mounts the respective lever 3 for angular displacement between the intermediate position, a partially retracted position designated in FIG. 1 with reference numeral **3*a*, and a fully retracted position illustrated in FIG. 1 in broken lines and designated with the reference numeral 3*b*. A curved actuating member 2 extends between the other end portions of the levers 3 and is connected thereto by pivots 4. While the curved member 2 has been illustrated as being located in the plane of the drawing, it is to be understood that in reality it will extend substantially normal thereto so that, when stepped on, it will assume a less curved configuration whereby the pivot 4 will be displaced into a position indicated by the reference numeral 4*a*, and finally a substantially straight configuration in which the pivot 4 will assume the position indicated by the reference numeral 4*b*. Thus, when the curvature of the curved element 2 changes from 2 to 2*a*, the pivots 4 will be displaced in the lateral directions of the ski 12 in the direction of the arrows 17. It may also be seen from FIG. 1 that, when the lever 3 is in its position 3*b*, the free end portion thereof is located directly above or over the upper surface of the ski 12, whereas the free end portion is laterally adjacent the side surface 8 of the ski 12 when the lever 3 is in its positions indicated by reference numerals 3*a* and 3, respectively. Thus, the lever 3 clears the ski 12 for pivoting in an upward and downward direction and laterally of the ski 12** between the above-mentioned intermediate and extended positions.

The pivots 5 may be mounted either directly on the upper surface of the ski 12 or on the lateral extensions thereof, or even on extensions of the side surfaces 8 of the ski 12. In any event, the pivots 5 will be so constructed and the levers 3 so mounted thereon as to permit the above-mentioned pivoting and angular displacement of the levers 3 relative to the ski 12. The curved member is preferably constructed as a unit and has elastically yieldable properties so that, when the ski 12 becomes detached from a ski boot, the curved member 2 will act as a spring which will displace the levers 3 from their fully retracted positions into their intermediate positions. The curved member 2 may be a wire spring or a leaf spring, and a step-on plate separate from or a part of a ski binding may be attached thereto.

Coming now to the diagrammatic illustration of FIG. 2, it may be seen that in this embodiment the braking elements or levers 3 are to be displaced between their full-line position and their broken-line position 3' which correspond to the intermediate and the fully retracted positions, respectively, that is, in the direction of the arrows 18. In this embodiment, the levers 3 are also mounted, in a non-illustrated manner, on the ski 12 for pivotal displacement between the intermediate position and the extended position. Pivots 6 are located at the other ends of the levers 3 which are spaced from the free ends of the levers 3, and may be connected by a connecting element 19 with one another. The curved element of this embodiment includes a pair of links or end portions 10, and a connecting portion 9 which extends between and is connected to the end portions 10 for an elastically yieldable pivoting displacement of the end portions 10 with respect to the connecting portion 9. The end portions 10 may be elements separate from the connecting portion 9 and pivotally connected thereby by pivots 11 which may be spring-loaded in a sense increasing the angle between the respective end portions 10 and the connecting portion 9. However, the reference numerals 9 and 10 may also indicate different portions of a unitary curved member of an elastically yieldable material.

As also illustrated in FIG. 2, the end portions 10 enclose an acute angle with the upper surface of the ski 12 so that, when the connecting portion 9 is displaced toward the upper surface of the ski 12 as a result of, for instance, stepping either directly on the connecting element 9 or a step-on plate connected thereto, the connecting portion 9 will assume its position indicated by the reference numeral 9*a*, while the respective end portion 10 will assume the position 10*a*. Inasmuch as the levers 3 are pivoted at the pivots 6, the displacement of the connecting portions into the positions 10*a* will result in movement of the free end portion of the respective lever 3 to a retracted position directly over the upper surface of the ski 12.

In the following description of the specific embodiments of the present invention the same reference numerals as employed in FIGS. 1 and 2 are used wherever functionally similar structure is applied, with alphabetical subscripts for the various embodiments and modifications.

Figure 4:
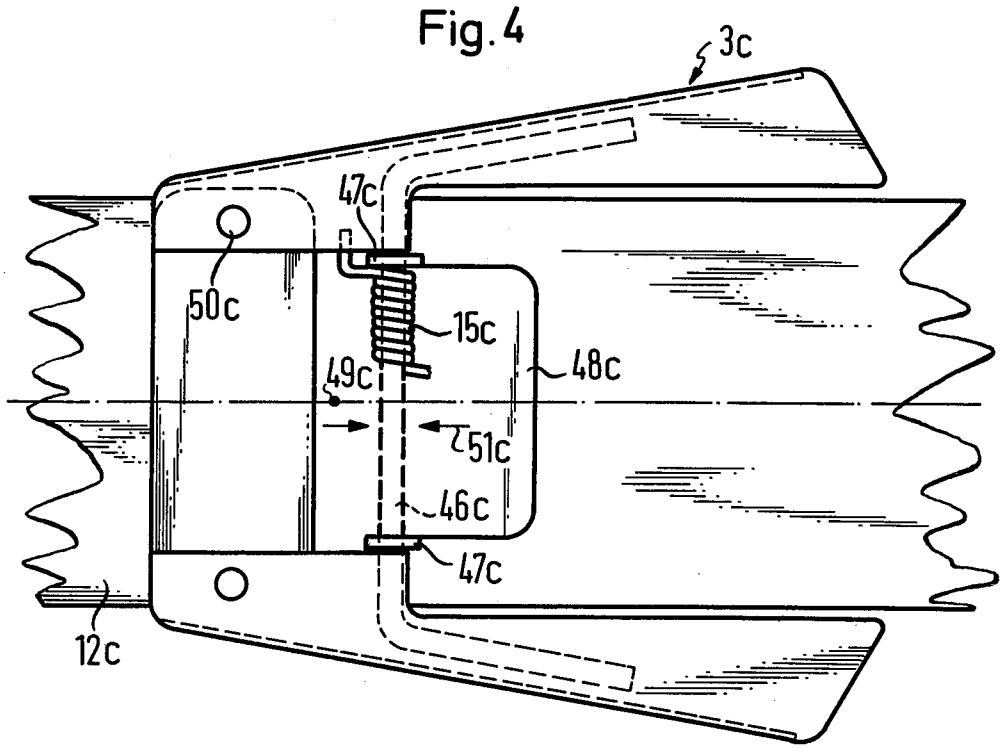
FIGS. 4 and 5 are top views of the brake as shown in FIG. 3 in the ready and retracted positions, respectively.
Figure 3:
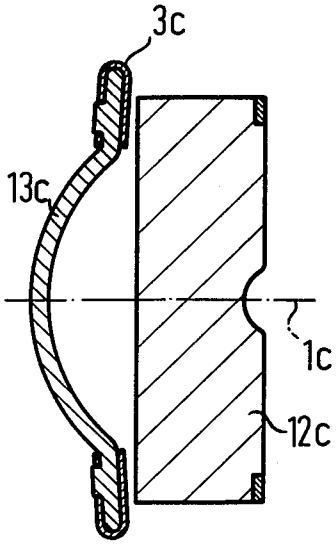
FIG. 3 is a cross-section through a first embodiment of the ski brake in accordance with the present invention.
Figure 5:
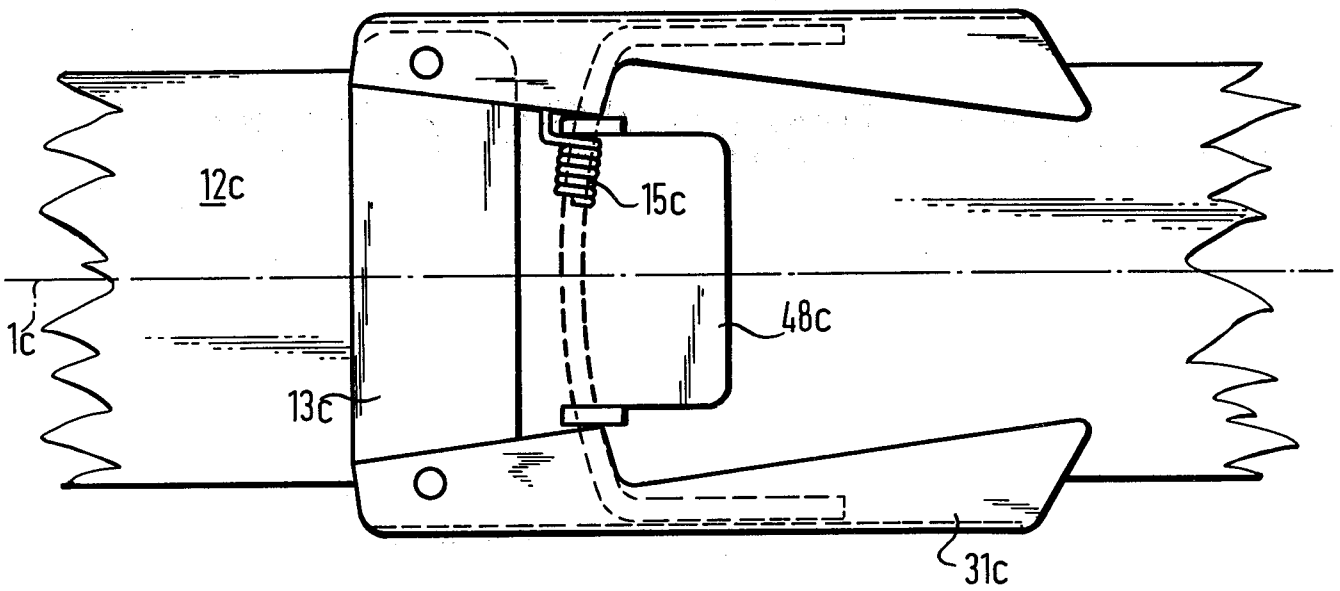

The embodiment shown in FIGS. 3–5 has a pair of synthetic-resin braking elements 3*c* pivoted at locations approximately two-thirds of the way from the snow-engaging lower ends or tips 31*c* of these elements. The two braking elements 3*c* are directly connected together by means of a bending axle or pivot 48*c* formed of spring steel and passing through lugs 47*c* forming journals on the support 48*c* of the ski brake. The step-on plate or actuating member 13*c* is similarly made of synthetic-resin material and is arcuately concave toward the upper surface of the ski 12*c* having longitudinal axis 1*c*. The ends of this member 13*c* are received in correspondingly shaped recesses in the upper ends of the elements 3*c* with pins 50*c* securing these ends in place, but permitting limited pivoting of the elements 3*c* relative to the member 13*c*.

The pivot axis 46*c* as described above is elastically bendable as seen by comparison of FIGS. 4 and 5. The limit of this bending is established by an abutment 49*c* provided on the plate 48*c*. In addition the axle 46*c* passes through a pivot spring 15*c* which has one end bearing against the support 48*c* and another end imbedded in one of the elements 3*c* so as to urge this and the other element into the braking position with the tip 31*c* extending down below the lower surface of the ski 12*c* and the step-on bar 13*c* spaced above the upper surface of the ski 12*c*. The axle 46*c* has a diameter 51*c* slightly smaller than the internal diameter of the spring 15*c* so that relative rotation is possible. It is, of course, possible to provide two such springs 15*c*, each engaging a respective one of the element 3*c*.

Figure 6:
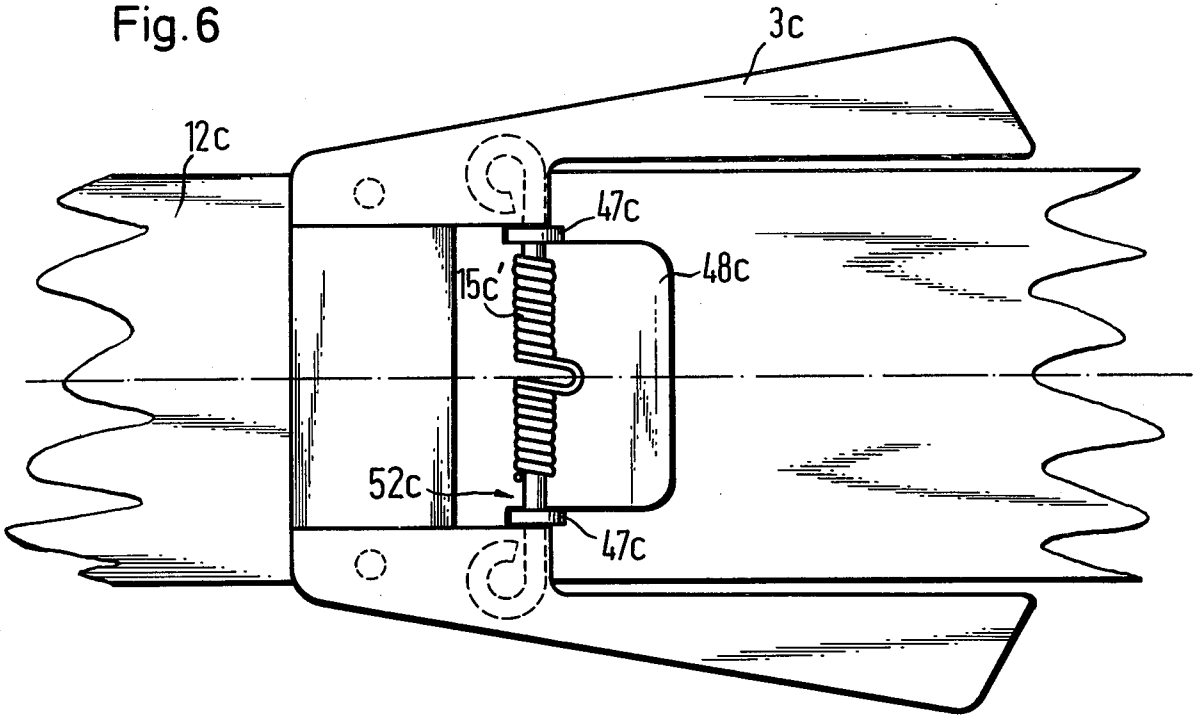
FIG. 6 is a view similar to FIG. 4 illustrating a modification of the first embodiment of the ski brake in accordance with the present invention.

The arrangement shown in FIG. 6 is substantially identical to that shown in FIGS. 3–5, except that here the axle 46*c* is replaced by a spring-steel wire 52*c* formed centrally as a coil spring 15*c*′ whose outer ends pass through the lugs 47*c* constituting the journals for the pivot and are bent over and imbedded in the elements 3*c*. The central portion of the spring 15*c*′ is formed as a loop bearing on the support 48*c* so that this spring simultaneously constitutes the pivot spring and the pivot. Furthermore, such a spring is inherently flexible so as to allow canting of the pivot axes of the elements 3*c* relative to each other. It would also be possible in this arrangement to use a two-piece central spring, and to interconnect these pieces by means of a central rod, a sleeve or the like.

In this arrangement the support 48*c* could be opened downwardly so as to cover the spring 15*c*′. Subsequent screwing of the plate 48*c* to the upper surface of a ski will therefore completely protect the mechanism of the ski brake.

Figure 8:
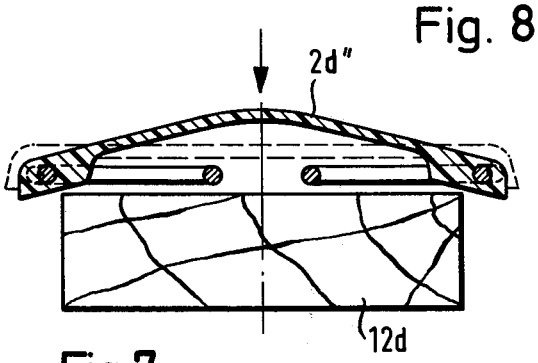
FIG. 8 is a section taken along line VIII—VIII of FIG. 7.
Figure 7:
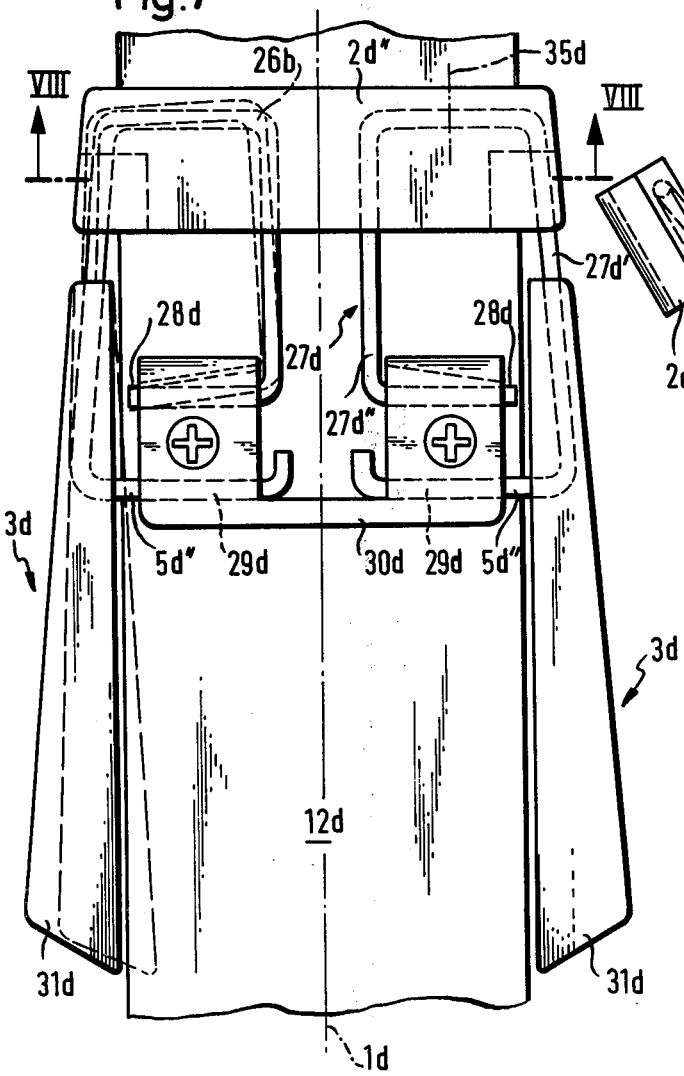
FIG. 7 is a top view of a second embodiment of a ski brake according to the present invention with the brake elements in the ready position.
Figure 9:
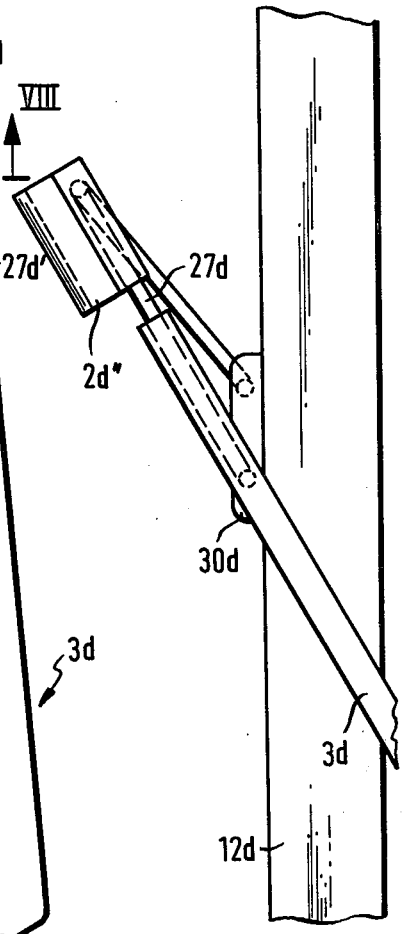
FIG. 9 is a side view of the brake of FIG. 7 shown in the braking position.

FIGS. 7 to 9 illustrate an embodiment of the present invention which also operates according to the principle illustrated in FIG. 1. FIG. 9 illustrates the brake arrangement in its extended position in which the curved member 2*d* is remote from the upper surface of the ski 12*d*. In this embodiment, a wire 27*d* has portions 26*d* which are embedded in the curved member 2*d* and in the levers 3*d*, axle portions 29*d* supported in a bearing block 30*d* and end portions 28*d* also supported in the bearing block 30*d*, in diverging bearing holes. The wire 27*d* is elastically yieldable so that it performs the function of the previously discussed pivot springs, that is, the displacement from the intermediate position to the extended position.

When the curved member 2*d* is stepped on, it is first displaced into abutment with the upper surface of the ski 12*d*, whereby the levers 3*d* are pivoted about the pivot point 5*d* between the extended position and the intermediate position. Further pressure exerted by the ski boot on the curved member 2*d* results in straightening of the latter into a position illustrated in particular in FIG. 8 in broken lines, whereby the transverse dimension of the curved member 2*d* increases, the portions 26*d* of the wire 27*d* are forced apart and the levers 3*d* are thus pivoted about the pivot points 5*d* into their retracted positions illustrated in the left-hand part of FIG. 7 in broken lines. Simultaneously therewith, the wire 27*d* is deformed as also illustrated in broken lines in FIG. 7, whereby the end portion 28*d* moves within the bearing provided in the bearing block 30*d*.

Upon relaxation of pressure upon the curved member 2*d*, the latter reduces its transverse dimension so that the levers 3*d* return into their intermediate positions, whereupon the wire 27*d* further pivots the levers 3*d* into their extended positions.

Figure 10:
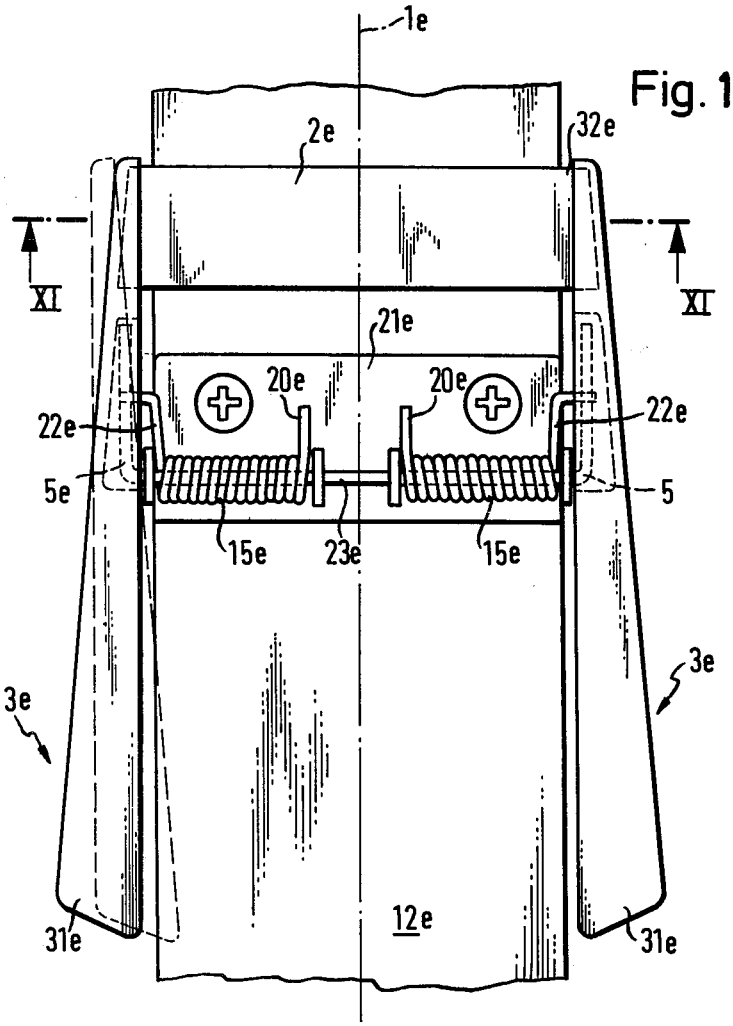
FIG. 10 is a top view of a third embodiment of the ski brake according to this invention.
Figure 11:
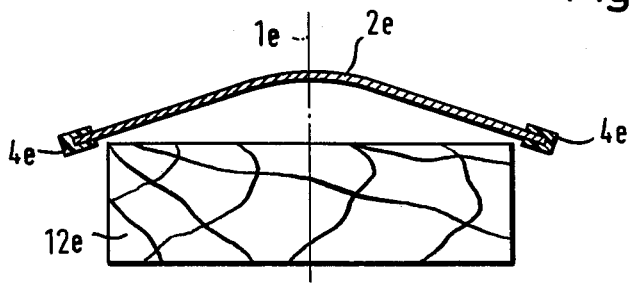
FIG. 11 is a section taken along line XI—XI of FIG. 10.

The braking elements 3*e* of FIGS. 10 and 11 are shaped as elongated levers which are mounted on an axle 23*e* for pivoting between the aforementioned extended and intermediate positions and about pivot points 5*e*. The curved member 2*e* is illustrated as having a rectangular configuration and as being curved away from the upper surface of the ski 12*e*. During the displacement of the levers 3*e* between the extended and intermediate positions, the curved member 2*e* moves away and toward the upper surface of the ski 12*e*, resting against it in the intermediate position of the levers 3*e*. The spaced ends of the curved member 2*e* are received in U-shaped grooves provided in the upper end portions of the levers 3e and which act as pivots. An abutment plate 21e is mounted on the upper surface of the ski 12e, and the axle 23e is supported thereon in a conventional manner by means of bearings. A pair of springs 15e is also mounted on the axle 23e, each of them having one end portion 20e which abuts abutment plate 21e, and another end portion 22e which is connected to the respective lever 3e. The springs 15e urge the levers 3e toward their extended positions.

The levers 3e are illustrated in their intermediate positions in solid lines, that is in such positions which are assumed when the curved member 2e abuts the upper surface of the ski 12e but prior to deformation of the curved member 2e. Now, when the curved member 2e is deformed, that is straightened as a result of movement of the ski boot toward the upper surface of the ski 12e, the pivot points 4e are pushed outwardly of the ski 12e in the transverse direction of the ski and thus the levers 3e are angularly displaced about the pivot points 5e. To render possible such angular displacement of the levers 3e, a bent portion of the axle 23e is accommodated within the respective lever 3e in a diverging bearing recess as illustrated in broken lines. When the curved member 2e is straightened to its utmost extent, the respective lever 3e assumes the position illustrated in broken lines at the left-hand part of FIG. 10, that is the engaging portion of the respective lever 3e is located over the upper surface of the ski 12e. Thus the lever 3e in its retracted position does not interfere with the proper operation of the ski.

Upon detachment of the ski 12e from the ski boot the above-described operation is reversed. Thus, the curved member 2e first reassumes its bent configuration illustrated in FIG. 10 which results in angular displacement of the levers 3e into their illustrated intermediate positions, and then the springs 15e pivot the levers 3e from the intermediate positions to the extended positions thereof. In the extended positions the engaging portions of the levers 3e engage the surface on which the ski 12e is supported, that is for instance the surface of the ski laying on the ski slope, and dig into it, thereby preventing unintended down-hill travel of the detached ski 12e.

Figure 13:
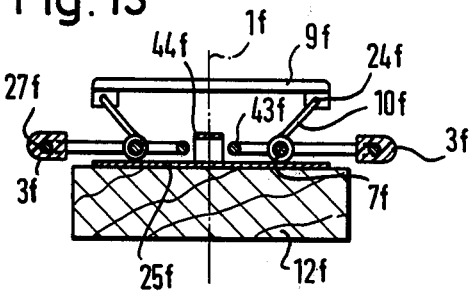
FIG. 13 is a section taken along line XIII—XIII of FIG. 12.
Figure 12:
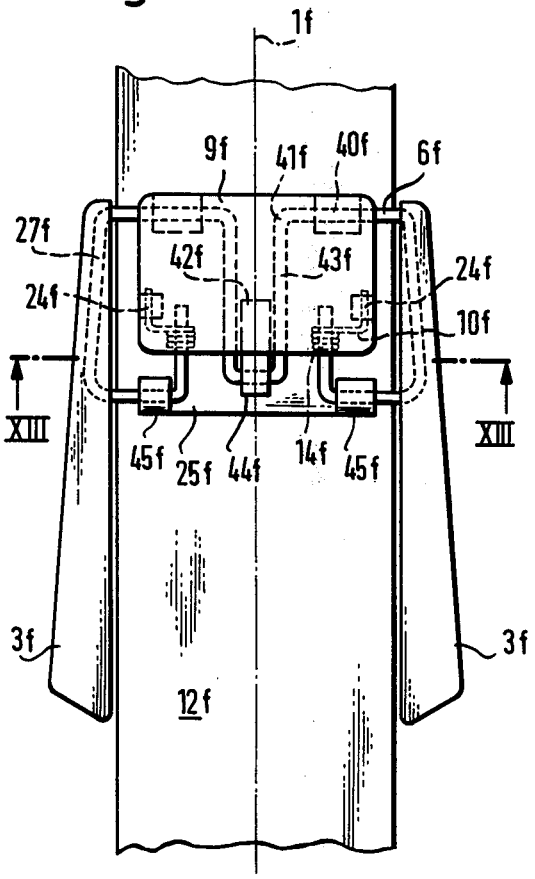
FIG. 12 is a top view of a fourth embodiment of the ski brake of this invention with the brake elements in the ready position.
Figure 14:
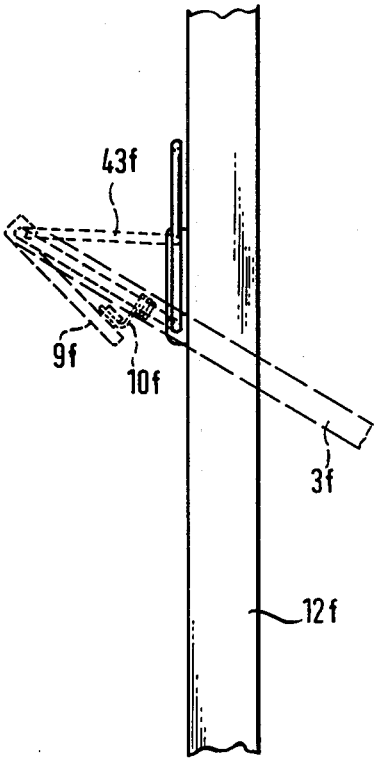
FIG. 14 is a side view of the ski brake of FIG. 12 with the brake elements in the braking position.

The fourth embodiment of the ski brake according to the present invention shown in FIGS. 12–14 has mounted on a ski 12f with longitudinal axis 1f a wire 27f which passes through a pivot journal 45f formed on a support plate 25f. The braking elements 3f are molded around the wire 12f with portions 6f journalled at 40f in the plate 9f adapted to be stepped on by the ski boot of the skier. A spring 10f formed as a link has a 1f secured at 24f in the plate 9f and another end wrapped at 14f around the end of the wire 27f. Furthermore the wire 27f is bent into a loop as shown at 41f and received in an elongated slot 44f formed in a holder 42f formed in turn on the plate 25f.

The wire 27f is formed of spring steel and assumes when unstressed the position illustrated in FIG. 14 in dashed lines. Thus the step-on plate 9f lies at an angle to the elements 3f and the loop 43f lies at an angle both to the actuating plate 9f and the elements 3f, holding them in the braking or extended position.

Pressing the plate 9f from the up position shown in FIG. 13 to the down position shown in FIGS. 12 and 14 flattens out the wire 27f so that it lies in substantially a single plane parallel to the upper surface of the ski 12f. This causes the brake elements 3f first of all to be bent up to lie parallel to the upper surface of the ski, and simultaneously forces the intermediate portions of these elements 3f inwardly so as to swing the brake elements 3f over top of the ski 12f pincher-fashion, that is pivoting about their upper ends which are spaced apart by a fixed distance.

It is noted in this regard that the loop 41f can be dispensed with and a compression spring provided under the plate 9f to achieve the same effect. In this case the two upper portions 6f will run straight across the plate 9f. Furthermore a two-part wire can be used instead of the one-piece wire 27f.

The embodiment illustrated in FIGS. 15 to 17 illustrates a construction which embodies the principle explained above in connection with FIG. 2. Here again, the same reference numerals have been used to designate similar parts.

The curved member of this embodiment includes a unitary bracket including a connecting portion 9g and a pair of end portions 10g which are connected to the connecting portion 9g at locations 24g. The curved member is of an elastically yieldable material so that it will have a tendency to assume the position which is illustrated in particular in FIG. 16. Here again, the levers 3g are mounted on axles 23g which extend transversely of the ski 12g, for pivoting between a non-illustrated extended position and an intermediate position which is shown in FIGS. 15 to 17 in solid lines. During this pivotal displacement, the curved member 9g, 10g will be displaced away from and toward the upper surface of the ski 12g. Similarly to the previously discussed embodiments, springs 15g urge the levers toward their extended positions. A step-on plate 13g is connected to the connecting portion 9g and is pivotally mounted on an axle 16g. The axle 16g and the axles 23g are parts of a unitary mounting element which is partially embedded in the respective levers 3g. The end portions 10g are provided at their free ends with arcuate receptacles 14g in which portions of the mounting element 16g are pivotally received. When the step-on plate 13g is stepped on, first the levels 3g are pivotally displaced about the axles 23g from the extended positions to the intermediate positions thereof against the action of the springs 15g. When the end portions 10g contact the upper surface of the ski 12g, further displacement of the step-on plate 13g toward the upper surface of the ski 12g results in deflection of the end portions 10g toward the connecting portion 9g so that the distance between the arcuate receptacles 14g decreases, the axles 23g are displaced transversely of the axis 1g of the ski 12g into the positions illustrated in broken lines in the left-hand part of FIG. 16 and, since the mounting element 16g is embedded in the respective levers 3g, the latter are displaced into their retracted positions illustrated in broken lines in FIG. 16.

When the ski 12g becomes detached from the ski boot, the end portions 10g are first relaxed so that they move apart from one another into the position illustrated in FIGS. 15 and 16 and subsequently the springs 15g displace the levers 3g toward their extended positions in which the levers engage the surface on which the ski is supported.

The fifth embodiment shown in FIGS. 15–17 can be modified as shown in FIGS. 18–19. Here the braking elements 3h are displaceable transversely relative to the axis 1h of the ski 12h, but remain at all times parallel to each other. In this arrangement a synthetic-resin actuating plate 9h also remains parallel to the elements 3h at all times. This plate 9h is pivoted at 24h to rigid links 10h pivoted at 7h to inner extensions 37h of the elements 3*h*. Each of the elements 3*h* further has approximately halfway from its lower end 31*h* a pivot wire or rod 36*h* embedded in the element 3*h* and bent over as illustrated in FIG. 19.

Each rod 36*h* is of non-circular section and is received within a sleeve 38*h* having a central hole of similar non-circular section so that the two rods 36*h* are rotationally linked to each other through the sleeve 38*h*. A torsion spring 15*h* has one central section bearing on the support plate 21*h* and outer ends bearing on the inner extensions 37*h* so as normally to pivot the elements 30*h* into the braking position illustrated in dashed lines in FIG. 20.

A compression coil spring 3*h* received within tubular interfitting formations 39*h* on the plate 9*h* and on the support formed by the plate 31*h* and the upper surface of the ski 12*h* urges the plate 9*h* away from the ski in the up position shown in FIG. 19. Depression of this plate 9*h* downwardly toward the surface of the ski against the force of the spring 34*h* first of all pivots the element 3*h* into positions parallel to the axis 1*h* of the ski 12*h*. Once the sections 37*h* and the pivots 7*h* lie against the upper surface of this ski 12*h*, however, continued depression of the plate 9*h* will lever these pivots 7*h* inwardly and simultaneously pull the elements 3*h* inwardly toward the axis 1*h* of the ski. This will cause the pivot rods 36*h* to telescope within the sleeve 38*h*.

It is also possible in this arrangement to provide a sleeve on the elements 3*h* and use a pin on the plate 21*h* that telescopes within the sleeves on the elements 3*h*.

It will be understood that each of the elements described above, or two or more together, may also find a useful application in other types of structures differing from the types described above.

While the invention has been illustrated and described as embodied in a ski brake, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A brake for an elongated ski having an upper surface and a pair of sides, said brake comprising:

a support securable to said upper surface of said ski;

pivot means on said support defining a horizontal pivot axis generally parallel to said surface and transverse to said ski;

an elongated brake element at one side of said ski and having an upper end portion, a lower end, and an intermediate portion, one of said portions being secured to said pivot means for pivoting of said element about said horizontal axis between a braking position extending transverse to and downwardly past said ski and a rest position extending generally parallel to and lying above said surface, said element further being movable on said pivot means in said rest position between a ready position in which said lower end is spaced laterally relative to the longitudinal direction of said ski from said one side of said ski and a retracted position in which said lower end overlies said surface;

a pivot spring engaged between said element and said support and urging said element into said braking position; and actuating means including a link connected substantially directly to said element and an actuating member connected substantially directly to said link, bearing through said link on one of said portions transversely of said longitudinal direction and generally parallel to said surface, and displaceable generally perpendicular relative to said surface from an up position relatively far from said surface to a down position relatively close to said surface for displacing said element about said horizontal axis from said braking position into said rest position and along said horizontal axis from said ready position into said retracted position.

2. The ski brake defined in claim 1 wherein two such elements, pivoted at their intermediate end portions and each having a respective such link, flank said support, said links each having one end hinged on said actuating member and another end pivoted on the respective element, said links extending at an angle to said surface in said rest and ready positions of said elements.

3. The ski brake defined in claim 2, further comprising a compression spring urging said member away from said surface.

4. The ski brake defined in claim 2 wherein said pivot means includes a sleeve secured to said support and a pivot pin on each of said elements telescoped in a respective end of said sleeve, whereby said elements move perpendicular to said direction between said ready and retracted positions.

5. The ski brake defined in claim 4 wherein said pins and sleeve are of complementary nonround section so as to be rotationally linked, said sleeve extending along said horizontal axis and being rotatable on said support thereabout.

6. The ski brake defined in claim 2 wherein said links are hinged on said actuating member and on the respective upper end portions.

* * * * *